United States Patent [19]

Tatham et al.

[11] Patent Number: 4,901,880

[45] Date of Patent: Feb. 20, 1990

[54] SCORE LINE GROOVE FOR CONTAINER END MEMBERS

[75] Inventors: Richard L. Tatham, Evergreen; Alan D. Hunter, Littleton, both of Colo.

[73] Assignee: Adolf Coors Company, Golden, Colo.

[21] Appl. No.: 294,399

[22] Filed: Jan. 9, 1989

[51] Int. Cl.[4] ..... B65D 41/32

[52] U.S. Cl. ..... 220/269

[58] Field of Search ..... 220/268, 266, 269

[56] References Cited

U.S. PATENT DOCUMENTS

| | | | |
|---|---|---|---|
| 3,977,561 | 8/1976 | Strobe et al. | 220/269 |
| 4,024,981 | 5/1977 | Brown | 220/269 |
| 4,084,721 | 4/1978 | Perry | 220/269 |
| 4,184,607 | 1/1980 | Potts | 220/269 X |
| 4,320,850 | 3/1982 | Drolen Jr. | 220/269 |
| 4,402,421 | 9/1983 | Ruemer Jr. | 220/269 |
| 4,684,059 | 8/1987 | Rusnock | 229/52 B |

*Primary Examiner*—Steven M. Pollard
*Attorney, Agent, or Firm*—Klaas & Law

[57] ABSTRACT

This invention provides an end member adapted for sealed engagement with a container member wherein the end member has a central end wall portion which includes a severable tab portion. A hinge portion is integral with the central end wall portion and has spaced apart ends. At least one severable score line groove is formed in the central end wall portion and has a main body portion having end portions which define the spaced apart ends of the hinge portion and also defines the severable tab portion which may be severed by axially inwardly directed forces applied thereto so as to form an outlet opening in the central end wall portion. The hinge portion retains the severed tab portion attached to the central end wall portion. One end portion of the severable score line groove has first and second sections with the first section having a score residual greater than the score residual of the main body portion to ensure that the tearing of the score line groove extends in a direction opposite to the first section and the second section has a score residual greater than the score residual of the first section so as to inhibit the tearing of the severable score line groove and extends in a direction transverse to the direction of extent of the hinge portion, and the other end portion extends in a direction away from the one end portion to ensure that the tearing of the score line groove does not extend along the hinge portion. The other end portion which defines one end of the hinge portion is arcuate.

18 Claims, 2 Drawing Sheets

FIG 1
(PRIOR ART)
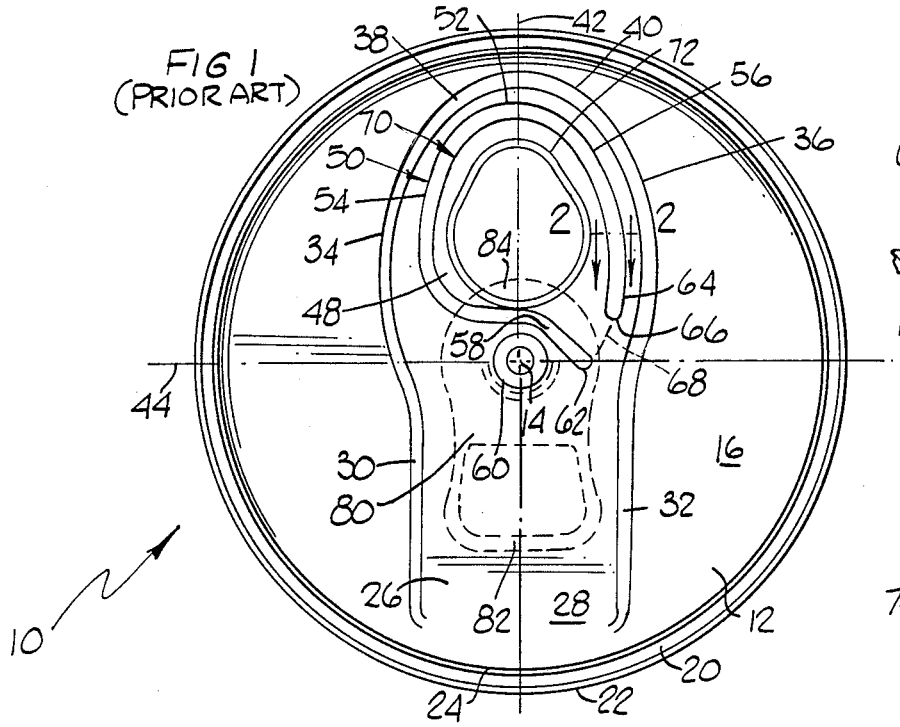
FIG. 2
(PRIOR ART)
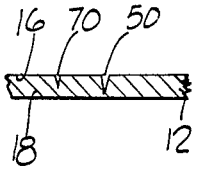
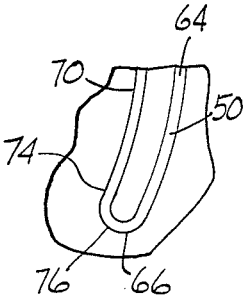
FIG. 3
(PRIOR ART)
FIG. 4
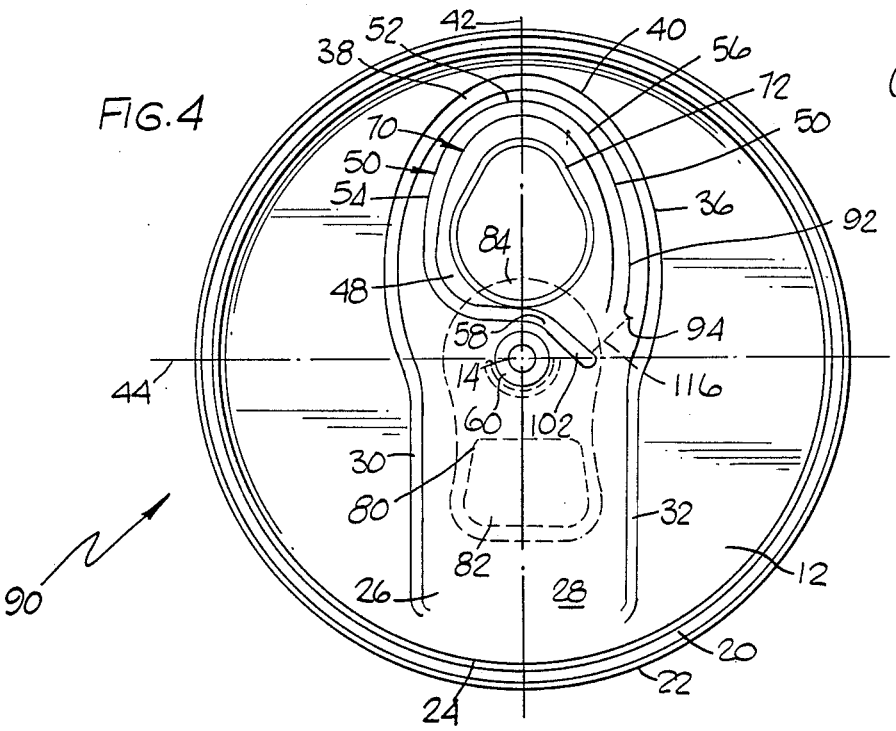

SCORE LINE GROOVE FOR CONTAINER END MEMBERS

FIELD OF THE INVENTION

This invention relates generally to a system for forming an opening in the end member of a beverage container so that the beverage therein may be readily removed therefrom and more particularly to an ecology type of beverage container end member wherein a tab means which is displaced to form the opening remains permanently secured to the container end member after the opening has been formed.

BACKGROUND OF THE INVENTION

In the commercial marketing of beverages, such as beer and soft drinks, it is highly desirable to market such beverages in a manner to enhance consumer acceptance. One of the more common methods of marketing beverages is in containers, such as two piece aluminum or steel cans, which are provided with easy opening tab means of some nature. One such type of easy opening tab means is known as the stay on tab (S.0.T.) wherein a non-closed score line groove is provided in a can end member and a force applying means is secured to the can end member at a location immediately outside a portion of the score line groove by suitable means such as a rivet. In this type of can end member, the force applying means is hingedly connected to the rivet. In operation, a force is applied to the force applying means and through the hinge association with the rivet, this force is applied to the scored tab portion of the can end member to break the score line groove. The continued application of force pushes the scored portion down into the can. The non-closed portion of the score line groove retains the scored portion with the can end member and the force applying means remains attached by the rivet to remain with the can end member. While these containers normally function as planned, there is always room for improvement to ensure that the opening is formed with no detrimental side effects.

BRIEF DESCRIPTION OF THE INVENTION

This invention provides a stay on tab container wherein the score line groove defining the severable tab portion is modified to ensure that the score line groove tears correctly so that the severable tab portion is opened and remains on the end member.

In the preferred embodiment of the invention there is provided a container end member for sealed association with a container member wherein the end member comprises a one piece metallic end member having a cylindrical peripheral rim wall portion, a central axis and an annular outer rim portion for sealed engagement with the container member. A central end wall portion is integral with the rim portion and has an outer surface and an inner surface. A hinge portion is integral with the central end wall portion and has spaced apart ends. At least one severable score line groove is formed in the central end wall portion and has end portions defining the spaced apart ends of the hinge portion and also defines a severable tab portion so that the severable tab portion may be pushed downwardly into the container in response to applied axially inwardly directed forces and form an outlet opening in the central end wall portion. A pivotally mounted pull tab is secured to a centrally located rivet for applying the forces to the severable tab portion. Retaining means are provided for retaining the severed tab portion attached to the central end wall portion and comprise the hinge portion. One end portion of the score line groove closer to the rivet is formed so that it gradually becomes thicker as it approaches its end to ensure that the score line groove tears in the opposite direction. The one end portion extends in a direction transverse to the direction of extent of the hinge portion. The other end portion of the severable score line groove extends in a direction away from the one end portion to ensure that the hinge portion is always formed on the central end wall portion. This is accomplished by forming the other end portion as an arcuate portion ending in a direction away from the one end portion.

BRIEF DESCRIPTION OF THE DRAWINGS

An illustrative and presently preferred embodiment of the invention is shown in the accompanying drawings in which:

FIG. 1 is a top plan view of a container end member of the prior art;

FIG. 2 is an enlarged cross-sectional view taken on the line 2—2 of FIG. 1;

FIG. 3 is an enlarged top plan view of a portion of FIG. 1;

FIG. 4 is a top plan view of a container end member of the preferred embodiment of this invention.

DETAILED DESCRIPTION OF THE INVENTION

Figure 5:
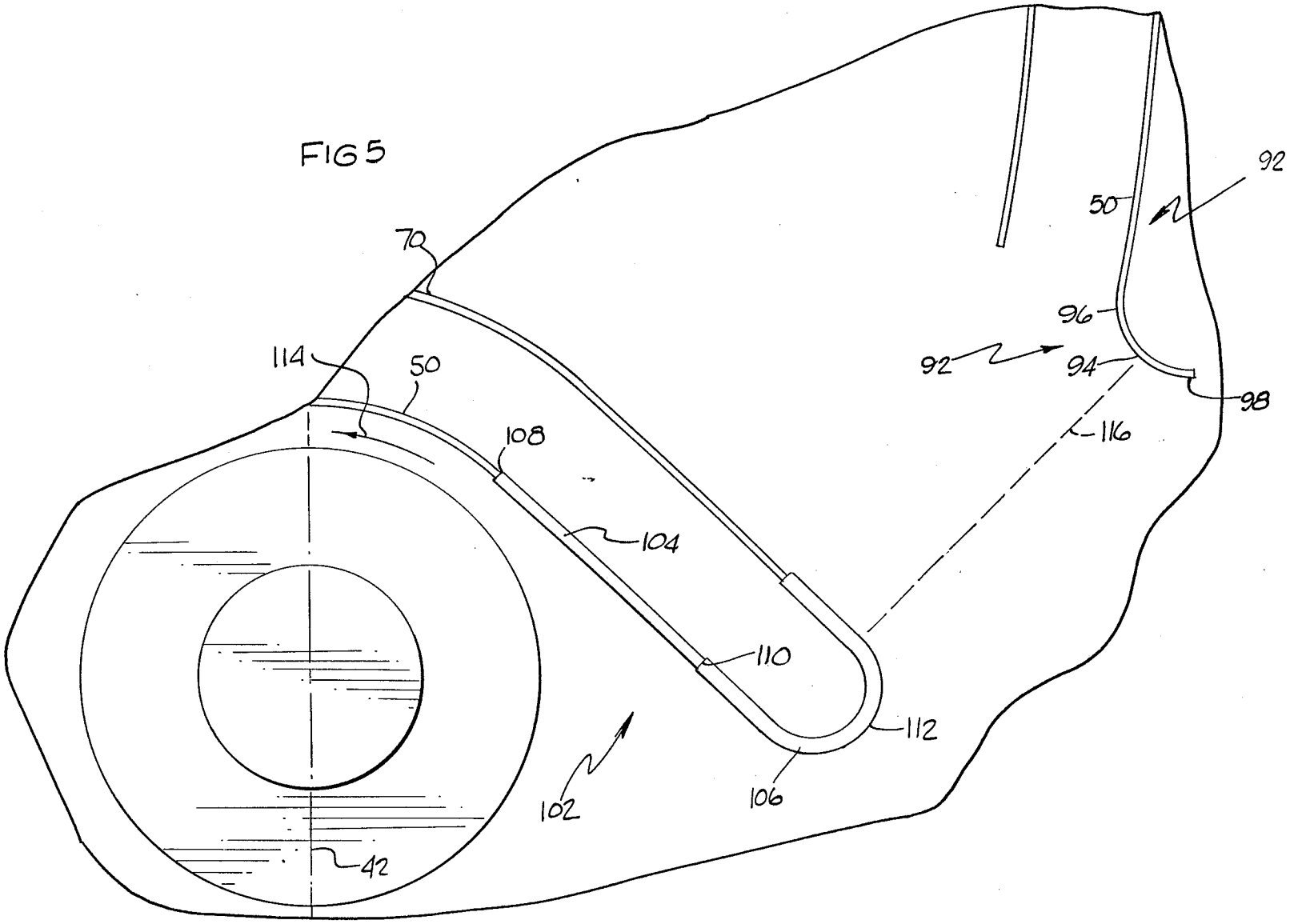
FIG. 5 is an enlarged top plan view of a portion of FIG. 4.

In FIGS. 1–3, there is illustrated a container end member 10, formed from a blank of sheet material such as, for example, an aluminum alloy of approximately 0.0108 inch in thickness having a central end wall portion 12 and a central axis 14, to provide an outer surface 16 and an inner surface 18, FIG. 2, when the container end member 10 is used with a container (not shown). The central end wall portion 12 is axially inwardly off-set from an annular exterior rim portion 20 having an axially outwardly facing end surface 22 and integrally connected to a generally radially inwardly directed flange portion 24 which is also integral with the central end wall portion 12.

A generally rectangularly shaped, axially inwardly depressed panel portion 26 is formed in the central end wall portion 12 and extends downwardly in a axially inward direction from the central end wall portion 12. The depressed panel portion 26 has a flat inclined outer end portion 28, two spaced apart generally parallel elongated axially inwardly inclined side edge portions 30 and 32 and two spaced apart curved, axially inwardly inclined edge portions 34 and 36 having central end portions 38 and 40. The container end member 10 has a first diametrical reference line 42 and a second diametrical reference line 44.

A severable tab portion 48 is located generally between the curved edge portions 34 and 36. The configuration of the severable tab portion 48 is defined by an outer score line groove 50 in the outer surface 16 of the depressed panel portion 26. The outer score line groove 50 has a curved end portion 52 extending across the first diametrical reference line 42 and located adjacent to the end portions 38 and 40 of the depressed panel portion 26, a pair of spaced curved side portions 54 and 56 on opposite sides of the first diametrical reference line 42.

The curved side portion 54 has a terminal end portion 58 extending across the first diametrical reference line 42 and located a relatively small distance from a portion of the periphery of a central rivet 60, described below, and having a terminal end portion 62. The curved side portion 56 has a terminal end portion 64 having a terminal end 66. The curved end portion 52 and curved side portions 54 and 56 comprise the main body portion of the outer score line groove 50. An integral hinge portion 68 extends between the terminal end portion 62 and the terminal end 66. An inner score line groove 70, which is an insurance score line groove, has a configuration slightly smaller than the outer score line groove 50. Also, as illustrated in FIG. 2, the depth of the inner score line groove 70 is substantially less than the depth of the outer score line groove 50. The depth of the score line groove is expressed by the score residual, which is the material remaining in the groove, and for score line groove 50 the score residual is about 0.0032 inch and for score line groove 70, the score residual is about 0.0066 inch. A closed reinforcing rib 72 extends in an axially outward direction from the severable tab portion 48 and has a configuration similar to a portion of but slightly smaller than the inner score line groove means 70.

The end portions of the outer 50 and inner 70 score line grooves are illustrated in FIG. 3. The terminal end 66 is semi-circular having a radius of about 0.025 inch. The depth of the inner score line groove 70 begins to get deeper at the start 74 of the semi-circle and reaches the depth of the outer score line groove 50 at a tangent 76 to the middle of the semi-circle. The terminal end portion 58 and terminal end 62 are similarly formed.

A pull tab 80 is secured to the rivet 60 for pivotal movement and has one end portion 82 adapted to be contacted by a finger of an user and another end portion 84 adapted to contact the severable tab portion 48 and apply an axially inwardly directed force thereto.

The container end member 90 illustrated in FIGS. 4 and 5 is the same as the container end member 10 except for the terminal end portions 92 and 102 so that corresponding parts have been given the same reference numerals. The terminal end portion 92 of the outer score line groove 50 has a terminal end portion 94 that is one quarter of a circle having a radius of about 0.030 inch and starts at the point 96 and ends at the point 98 extending in a direction away from the terminal end portion 102. The depth of the outer score line groove 50 for the final 15 degrees is decreased to inhibit the extent of the tear. Prior to the start of the final 15 degrees, the outer score line groove has a score residual of about 0.0032 inch and the end of the 15 degree portion has a score residual of about 0.0052 inch.

The terminal end portion 102 is illustrated in FIG. 5 and has a first section 104 and a second section 106. The first section begins at a location 108 which lies on a radius from the intersection of the reference lines 42 and 44 which is about 44 degrees from the reference line 42 and continues in a linear direction a distance of about 0.113 inch to the location 110. The second section 106 ends at location 112. The main body portion of the outer score line groove 50 has a score residual of about 0.0032 inch. The first section 104 has a score residual of about 0.0052 inch so as to inhibit the tearing of the outer score line groove in the first section 104. The second section 106 has a score residual of about 0.0072 to inhibit further the tearing of the outer score line groove so that the tearing ends at least in the second section. Since the outer score line groove 50 begins to tear between location 108 and reference line 42 the first and second sections 104 and 106 ensure that the tearing of the outer score line groove 50 will extend in the direction away from the first and second sections 104 and 106 as indicated by the arrow 114. The integral hinge portion for the end member 90 extends generally along the dashed line 116 with the major portion of the integral hinge portion being located in the same half portion of the central end wall portion 12 having the severable score line groove located therein.

When forming an opening in the end member 90, an axially outwardly directed force is applied to the one end 82 of the pull tab 80 to pivot the pull tab about the rivet 60 so that the other end 84 applies an axially inwardly directed force to the severable tab portion 48. When sufficient force has been applied, the severable tab portion 48 will commence to tear along the outer score line groove 50 as described above. As the pivotal movement of the pull tab 80 is continued, the severable tab portion 48 moves further inwardly into the container and the tearing of the outer score line groove 50 continues. When the tearing of the outer score line groove means reaches the point 96, it follows the terminal portion 94 so that, when it reaches the end 98, it is moving in a direction away from the terminal end portion 102. Therefore, there is no tendency to continue the tear toward the terminal end portion 102.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A container end member or the like for sealed association with a container member to provide a sealed container and which is provided with a system for forming an opening therein comprising:

a one piece metallic end member having a cylindrical peripheral rim wall portion and a central axis;

an annular outer rim portion on said metallic end member for sealed association with the container member;

a central end wall portion integrally connected to said rim portion and extending generally transversely to said central axis and having an outer surface and an inner surface;

a severable tab portion integral with said central end wall portion;

a hinge portion integral with said central end wall portion and having spaced apart ends;

at least one severable score line groove having a main body portion and end portions defining said spaced apart ends of said integral hinge portion and defining said severable tab portion so that said severable tab portion may be pushed axially inwardly into said container in response to applied axially inwardly directed forces and form an outlet opening in said central end wall portion;

a pull tab secured to said central end wall portion by a rivet;

said at least one severable score line groove having a curved portion generally concentric with and spaced a short distance from said rivet;

retaining means comprising said hinge portion for retaining said severed tab portion attached to said central end wall portion;

one end portion of said severable score line groove extending in a linear direction from said curved portion and transverse to the direction of extent of said integral hinge portion; and the other end portion of said severable score line groove extending in an arcuate direction away from said linearly extending one end portion, said other end portion has an arcuate extent of about 90 degrees.

2. A container end member as in claim 1 wherein: said other end portion is an arc of a circle.

3. A container end member as in claim 1 wherein: the major portion of said integral hinge portion being located in the same half portion of said central end wall portion having the severable score line groove formed therein.

4. A container end member as in claim 1 wherein: the final 15 degrees of said other end portion has a score residual greater than the score residual in the first 75 degrees.

5. A container end member or the like for sealed association with a container member to provide a sealed container and which is provided with a system for forming an opening therein comprising:

a one piece metallic end member having a cylindrical peripheral rim wall portion and a central axis;

an annular outer rim portion on said metallic end member for sealed association with the container member;

a central end wall portion integrally connected to said rim portion and extending generally transversely to said central axis and having an outer surface and an inner surface;

a severable tab portion integral with said central end wall portion;

a hinge portion integral with said central end wall portion and having spaced apart ends;

at least one severable score line groove having a main body portion and end portions defining said spaced apart ends of said hinge portion and defining said severable tab portion so that said severable tab portion may be pushed axially inwardly into said container in response to applied axially inwardly directed forces and form an outlet opening in said central end wall portion;

retaining means comprising said hinge portion for retaining said severed tab portion attached to said central end wall portion;

one end portion of said severable score line groove extending in a direction transverse to the direction of extent of said hinge portion;

the other end portion of said severable score line groove extending in a direction away from said one end portion; and wherein said at least one severable score line groove comprises:

an outer score line groove and an inner score line groove;

said outer and inner score line grooves being joined at said one end portion;

said outer and inner score line grooves being separated at said other end portion with said outer score line groove extending in said direction away from said one end portion; and said outer score line groove having a score residual which is substantially less than the score residual of said inner score line groove so that said outlet opening is formed by tearing along said outer score line groove.

6. A container end member as in claim 5 wherein: said other end portion of said outer score line groove is arcuate.

7. A container end member as in claim 6 wherein: said other end portion has an arcuate extent of about 90 degrees.

8. A container end member as in claim 7 wherein: the final 15 degrees of said other end portion has a score residual greater than the score residual in the first 75 degrees.

9. A container end member as in claim 1 wherein: said one end portion of said severable score line groove having a score residual that is substantially greater than the score residual of said main body portion to ensure that said score line groove will tear in the direction of said main body portion and not in the direction of said one end portion.

10. A container end member as in claim 9 wherein said one end portion comprises:

a first section and a second section; and said second section having a score residual which is substantially greater than the score residual of said first section.

11. A container end member as in claim 9 wherein: said other end portion is arcuate.

12. A container end member as in claim 11 wherein: said other end portion has an arcuate extent of about 90 degrees.

13. A container end member as in claim 12 wherein: the final 15 degrees of said other end portion has a score residual greater than the score residual in the first 75 degrees.

14. A container end member or the like for sealed association with a container member to provide a sealed container and which is provided with a system for forming an opening therein comprising:

a one piece metallic end member having a cylindrical peripheral rim wall portion and a central axis;

an annular outer rim portion on said metallic end member for sealed association with the container member;

a central end wall portion integrally connected to said rim portion and extending generally transversely to said central axis and having an outer surface and an inner surface;

a severable tab portion integral with said central end wall portion;

a hinge portion integral with said central end wall portion and having spaced apart ends;

at least one severable score line groove having a main body portion and end portions defining said spaced apart ends of said hinge portion and defining said severable tab portion so that said severable tab portion may be pushed axially inwardly into said container in response to applied axially inwardly directed forces and form an outlet opening in said central end wall portion;

retaining means comprising said hinge portion for retaining said severed tab portion attached to said central end wall portion;

one end portion of said severable score line groove extending in a direction transverse to the direction of extent of said hinge portion;

the other end portion of said severable score line groove extending in a direction away from said one end portion;

said one end portion of said severable score line groove having a score residual that is substantially greater than the score residual of said main body portion to ensure that said score line groove will tear in the direction of said main body portion and not in the direction of said one end portion; and wherein said at least one severable score line groove comprises:

an outer score line groove and an inner score line groove;

said outer and inner score line grooves being joined at said one end portion;

said outer and inner score line grooves being separated at said other end portion with said outer score line groove extending in said direction away from said one end portion; and said outer score line groove having a score residual which is substantially less than the score residual of said inner score line groove so that said outlet opening is formed by tearing along said outer score line groove.

15. A container end member as in claim 14 wherein: said other end portion of said outer score line groove is arcuate.

16. A container end member as in claim 15 wherein: said other end portion has an arcuate extent of about 90 degrees.

17. A container end member as in claim 16 wherein: the final 15 degrees of said other end portion has a score residual greater than the score residual in the first 75 degrees.

18. A container end member as in claim 17 wherein said one end portion comprises:

a first section and a second section; and said second section having a score residual which is substantially greater than the score residual of said first section.

* * * * *